United States Patent [19]
Bross

[11] Patent Number: 4,495,720
[45] Date of Patent: Jan. 29, 1985

[54] HANDGUN MAGAZINE WITH POMMEL BASE

[76] Inventor: Robert Bross, Ballville Rd., Bolton, Mass. 01740

[21] Appl. No.: 445,925

[22] Filed: Dec. 1, 1982

[51] Int. Cl.[3] ..... F41C 25/00
[52] U.S. Cl. ..... 42/7
[58] Field of Search ..... 42/7, 50, 71 P

[56] References Cited

U.S. PATENT DOCUMENTS

| | | | |
|---|---|---|---|
| 2,205,967 | 6/1940 | Wise | 42/50 |
| 2,715,789 | 8/1955 | Garand | 42/50 |
| 2,828,568 | 4/1958 | Sakewitz | 42/50 |
| 3,143,819 | 8/1964 | Stevens | 42/50 |
| 3,273,275 | 9/1966 | Badali | 42/50 |
| 3,372,506 | 3/1968 | Wilhelm | 42/7 |
| 3,758,978 | 9/1973 | Theodore | 42/7 |
| 3,798,818 | 3/1974 | Casull | 42/72 |
| 4,276,709 | 7/1981 | Bross | 42/71 P |
| 4,343,107 | 8/1982 | Kaltenegger | 42/7 |
| 4,397,109 | 8/1983 | Pachmayr et al. | 42/50 |

*Primary Examiner*—Charles T. Jordan

*Attorney, Agent, or Firm*—Hamilton, Brook, Smith and Reynolds

[57] ABSTRACT

A pommel and means for mounting it to the closed end of a magazine which is releasably contained within a recess in the butt end of the grip of a handgun. The pommel (16) has a recessed interior (80) and exterior periphery (26, 27) which is complementary to and coincident with the shape of the butt end (13) of a handgun. There are releasable interlock means (72, 74) on the magazine (14) and complementary releasable interlock means (72, 74) on the magazine (14) and complementary releasable interlock means (98, 99) within the internal confines of the pommel.

8 Claims, 16 Drawing Figures

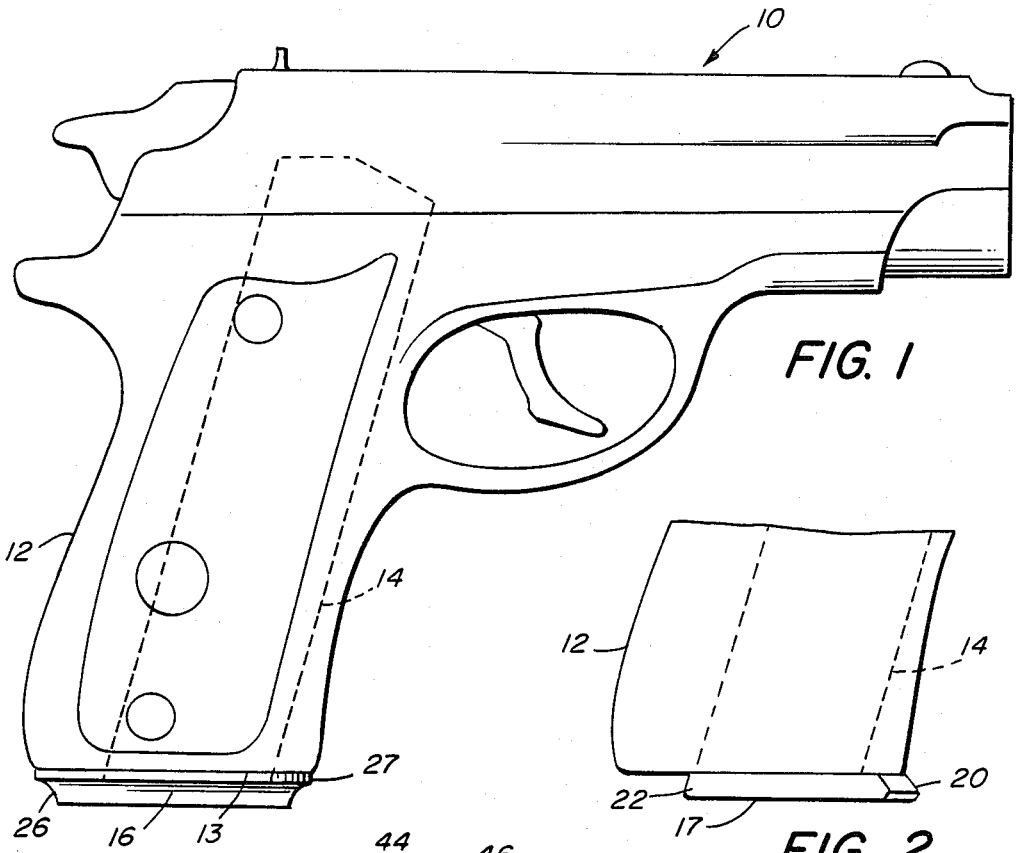
FIG. 1
FIG. 2
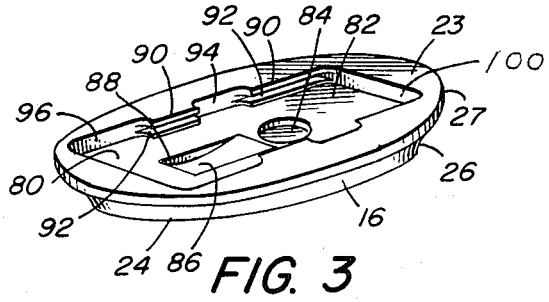
FIG. 3
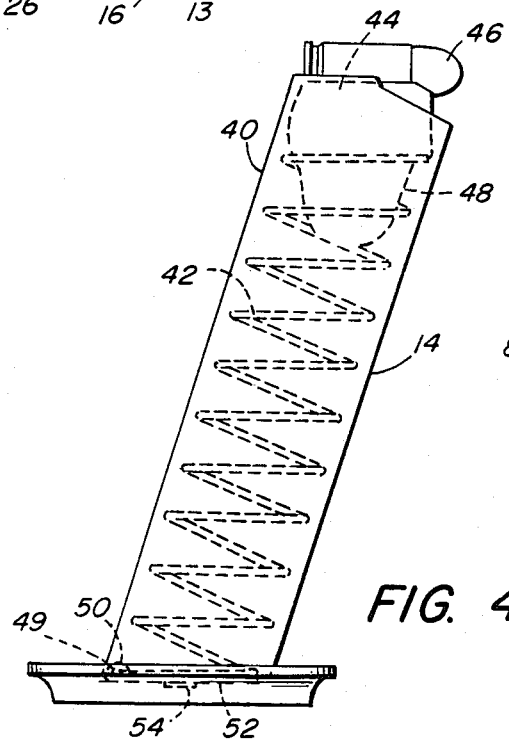
FIG. 4

HANDGUN MAGAZINE WITH POMMEL BASE

DESCRIPTION

1. Technical Field

This invention is in the field of firearms. More particularly, it relates to pommels which can be removably secured at the butt end of the grip area of handguns, particularly automatic or semiautomatic pistols which have removable magazines insertable in their grips.

2. Background Art

In U.S. Pat. No. 4,276,709, Applicant disclosed a butt plate or pommel which is particularly adaptable for attachment to the stocks or grips of revolvers. The revolver pommel comprises a pommel plate having a mounting boss extending from its inner surface and means for securing it to the removable stocks of a revolver.

The pommel, once having been attached to the grip portion of the revolver, serves a number of functions. Primarily it is decorative since it can be embossed with emblems or engraved with initials or the like. It also offers a base for an optional loop to which a lanyard may be attached. The weight of the pommel located at the butt of the revolver changes the balance of the overall revolver and also has an effect on recoil during firing.

The pommel disclosed in applicant's prior patent is removable and readily replaceable with pommels made of other materials or having other designs or shapes depending upon the wishes of the owner. In the replacement process the stocks, which are normally fastened to the frame of the revolver by a single transverse screw, are removed. Consequently, the grip or handle of the revolver must be taken apart in order to replace the pommel.

In an automatic or semiautomatic handgun, on the other hand, the butt of the gun normally is to some extent the bottom base plate of the cartridge-holding magazine, sometimes known as the clip. In contrast therefore to a revolver on which a pommel is attached, the pommel on an automatic gun is not attached to the stocks of the gun but is an integral part of the magazine per se and is removed every time the magazine is removed. Consequently, such a pommel cannot be added to or removed from an automatic handgun as it is from a revolver in the manner disclosed by applicant's prior patent for several reasons, one being, because automatic handguns, generally speaking, do not have a screw passing transversely through the stock and frame. In fact, if a screw did pass, in this manner, completely through the grip of an automatic, it could make it impossible to insert the magazine.

Typical magazines, or clips, for automatic handguns are shown in U.S. Pat. No. 2,828,568 to Sakewitz or U.S. Pat. No. 3,143,819 to Stevens. Generally speaking, the magazines comprise elongated housings, more or less rectangular in cross section, usually made of sheet metal and into which cartridges are placed. The cartridges are urged upwardly in the magazine by a spring which presses a follower against the lowermost cartridge or cartridges in the magazine. The lower end of the spring abuts a bottom plate or detent plate which is removably secured to a removable base plate of the magazine, generally by sliding engagement between mating flanges. Generally speaking, the base of the magazine constitutes a portion of the gun butt. It is approximately the size of the cross section of the magazine which, in turn, fits within the grip of the gun. Thus, the bottom or base plate is usually smaller than the bottom dimension of the gun grip and has little decorative effect and often no functional effect other than serving as the bottom of the magazine.

As shown in the Stevens patent, the base plate can present an interrupted surface occasionally with portions overhanging the bottom of the pistol grip or, conversely, as in Sakewitz, not coming to an end of the pistol grip.

It is one of the objects, therefore, of this invention to provide a pommel for an automatic pistol which is not only functional but also affords a smooth, continuous and uninterrupted base plate for the entire grip profile of the pistol.

Another object of the invention is to provide a pommel for an automatic handgun which is readily removable and replaceable with others of different design or appearance.

The above and other features of the invention including various novel details of construction and combinations of parts will now be more particularly described with reference to the accompanying drawings and pointed out in the claims. It will be understood that the particular handgun pommel embodying the invention is shown by way of illustration only and not as a limitation of the invention. The principles and features of this invention may be employed in varied and numerous embodiments without departing from the scope of the invention.

DISCLOSURE OF THE INVENTION

The invention resides in a functional, decorative pommel, and means for mounting it to the butt end of a magazine of the type which is releasably contained within the grip of a handgun, particularly an automatic or semiautomatic pistol. The pommel has a recessed interior and an exterior periphery which is complementary and coincident to the shape of the overall butt of the gun. There are releasable interlock means on the butt end of the magazine and complementary releasable interlock means within the confines of the recessed interior of the pommel. The pommel and the magazine may be secured together with the interlock means completely obscured from view when the magazine is inserted into the grip of the handgun.

The pommel itself is a plate having a continuous exterior wall coincident to the shape of the butt of the grip of a handgun. The interior recess in the pommel plate is defined by the interior surface of the wall. Longitudinal slots are formed in the wall and longitudinal flanges are formed at the butt end of the magazine. The slots and the flanges are arranged with mating interruptions in staggered relationship to permit the butt end of the magazine to enter the interior recess and to align the flanges with the slots to attach the pommel to the magazine by sliding engagement. Releasable detent means are provided to maintain the magazine and the pommel in an assembled relationship.

DESCRIPTION OF THE DRAWINGS

FIG. 1 is a side elevational view of an illustrative semiautomatic handgun having a pommel at the butt end of its grip made and mounted in accordance with this invention.

FIG. 2 is a partial side elevational view of a typical semiautomatic handgun having a magazine with a base plate of conventional construction. It may be considered prior art.

FIG. 3 is a perspective view of a pommel plate made in accordance with this invention.

FIG. 4 is a side elevational view of a cartridge magazine or clip for the handgun shown in FIG. 1.

BEST MODE OF CARRYING OUT THE INVENTION

Figure 5:
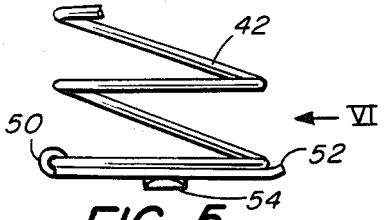
FIG. 5 is a side elevational view on a slightly enlarged scale of the spring and detent plate of the magazine.

In FIG. 1 there is disclosed a semiautomatic pistol 10 typical of many handguns. It includes a grip designated generally as 12 and includes a magazine 14 having at its butt end, a pommel 16 embodying features of the invention. The upper or discharge end of the magazine is inserted into the grip with the pommel interfacing the butt end 13 of the grip 12.

In FIG. 2 there will be seen what may be considered prior art. The base plate 17 has a leading end 20 extending beyond the grip 12 and an end 22, terminating short of the grip. This may be considered unattractive although there may be functional reasons for this type of construction.

Figure 10:
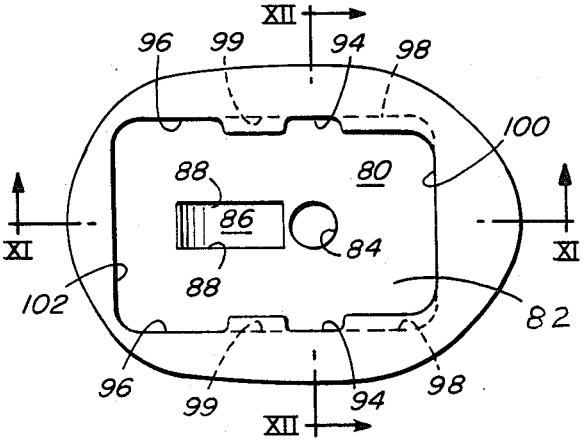
FIG. 10 is a top plan view of the pommel plate.

FIG. 3 shows a pommel plate 16 in perspective. The upper surface 23 is generally planar. Its lower surface 24 is generally planar or slightly convex and may be inlayed with an emblem or engraved. Its overall plan outline as seen in FIG. 10 is generally oval, but more importantly, is complementary and coincident the shape of the butt 13 of the particular handgun to which it is to be attached. It has a concave bevel 26 around its periphery which is optional and for decorative purposes only. The pommel plate will be described in more detail hereinafter.

Figure 6:
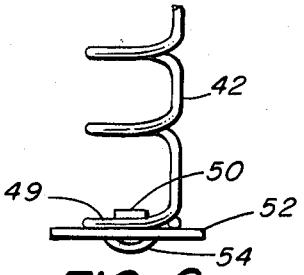
FIG. 6 is a front elevational view taken in the direction of the arrow VI on FIG. 5 of the spring and detent plate.
Figure 7:
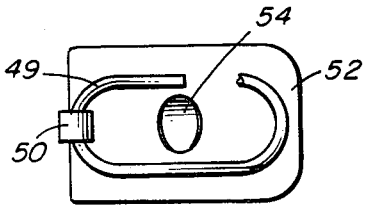
FIG. 7 is a top plan view of the detent plate of the magazine.

The magazine 14 will now be described. It includes a tubular column 40 of generally rectangular cross section and includes a compression spring 42. At the upper end of the spring is a conventional follower 44, the upper portion of which is contoured to engage a cartridge 46. The lower portion of the follower has a tang 48 which descends into the uppermost coil or coils of the spring. The lower end of the spring 42 has a terminal end 49 and as seen in FIGS. 6 and 7 engages beneath a curled-up tongue 50 extending upwardly from a detent plate 52. A detent 54 is pressed from the top out through the bottom of the plate 52 or may, for example, be a separate member secured to the plate 52.

Figure 8:
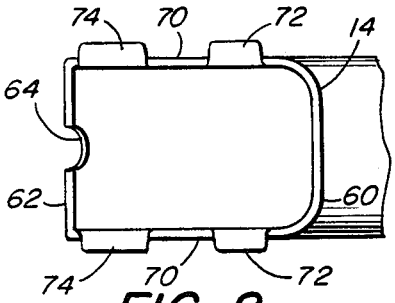
FIG. 8 is a bottom plan view of the butt end of the magazine.
Figure 9:
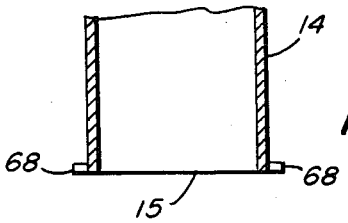
FIG. 9 is an elevational view partially in section of the butt end of the magazine.
Figure 11:
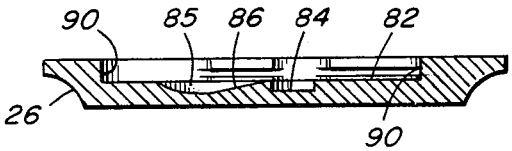
FIG. 11 is a sectional view of the pommel plate taken on the lines XI—XI of FIG. 10.
Figure 12:
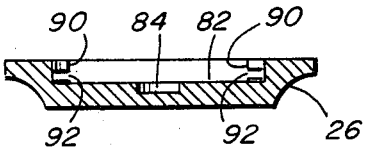
FIG. 12 is a sectional view of the pommel plate taken on the lines XII—XII of FIG. 10.

Referring next to FIGS. 8 and 9, the lower or butt end 15 of the magazine 14 will now be described. It has a leading end 60 and a trailing end 62, and its bottom is open. The trailing end 62 has an opening at 64 for reasons which will become more apparent hereinafter.

The butt end 15 of the magazine 14 is flanged outwardly along its sides as seen at 68 in FIG. 9. The flanges, however, are interrupted at 70 (FIG. 8) intermediate the leading and trailing ends leaving leading flanges 72 and trailing flanges 74 on both sides of the magazine.

The interruptions 70 need not necessarily be specifically as shown. They may, for example, be at the leading and trailing ends of the magazine or assume other positions.

Referring next to FIG. 3 and FIGS. 10 to 12, the pommel plate 16 will now be described. As seen in FIGS. 3 and 10, it is generally oval in configuration, but more importantly its circumference is formed complementary and coincident to the shape of the gun butt end 13 or bottom of the grip. On assembly, it interfaces with the grip to give a smooth continuous line as seen in side elevation FIG. 1 as distinguished from FIG. 2. As stated previously, the lower surface 24 of the pommel is generally planar, but it may be contoured or engraved or have a decorative or symbolic emblem secured to it. The upper surface 23, however, contains recessed interior 80. In its floor 82 is a detent receiving recess 84. The recessed interior is completely within the continuous outer wall 27 of the pommel. Adjacent to the recess 84 is a recessed ramp 86 having sidewalls 88. The lateral walls 90 of the recessed interior 80 contain slots 92.

The walls 90 are not continuous; hence the slots 92 are interrupted as at 94 and 96. The length of the interruptions 94 and 96 are slightly greater than the length of the flanges 72 and 74 on the magazine. The wall portion 90 where the slots 92 are found are slightly shorter in length than the interrupted portion 70 on the magazine 14. The interruptions 96 are at the trailing end 102 of the interior 80 of the pommel and correspond in position to the trailing flanges 74 on the magazine. The slots 94 at the leading end 100 of the recessed portion 80 and the flanges are in staggered mating relationship to each other.

The pommel 16 is assembled to the butt end of the magazine in the following manner. The follower 48 is inserted into the magazine 14 from the open bottom. It is engaged by the spring 42, the trailing end 49 of which is inserted through the turned up tongue 50 of the detent plate 52. While the detent plate 52 is held manually in position near the butt end of the magazine, the butt end is moved into position in the interior recess 80 of the pommel with the trailing flanges 74 aligned with the interruptions 96 and the forward flanges 72 aligned with the interruptions 94. The magazine is urged downwardly into the recessed portion 80 until the flanges are aligned with the slots. The detent 54 on the detent plate 52 enters the recessed ramp 86, its sides being contained by the walls 88 of the ramp to align it with the detent recess 84. When so aligned, the magazine 14 is urged to the right relative to the pommel as viewed in FIG. 10 with the leading flanges 72 entering the slotted portions 98 and the trailing flanges 74 of the magazine, moving from the interrupted areas 96 into the slots in the wall portion 99. This relative movement continues until the detent 54 engages the recess 84 under spring pressure while the leading edge 60 of the magazine interfaces the leading end 100 of the recessed portion 80. This places the pommel in a firm and secure location as the base of the magazine.

The magazine may then be inserted into the butt end of the grip and urged upwardly into conventional releasable locking position.

The pommel may be removed from the magazine by withdrawing the magazine from the gun and inserting a small flat tool into the recess 64 which permits the curled up tongue 50 of the detent plate to be cammed upwardly to ease the detent 54 from the recess 84. This permits the magazine and pommel to be separated by a sliding movement opposite to that by which they were assembled.

Alternative forms of contruction will now be described with reference to FIGS. 13 to 16.

In the illustrative example hereinabove described, the butt end 15 of the magazine 14 was flanged outwardly at 68, but many magazines in use today are flanged inwardly. In such instances, the same principles of the invention would be employed, however, the flange receiving slots instead of being formed in the walls 90 of the pommel 16 would be recessed in slots 104 formed in an island 103 extending upwardly from the recessed portion 80. The same staggered mating relationship between flanges and slots would be employed.

Figure 14:
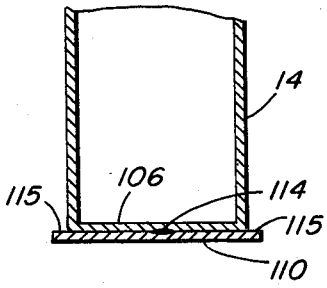
Figure 15:
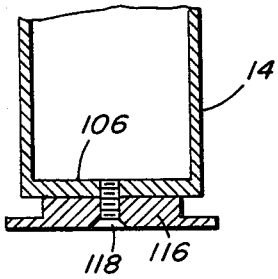
Figure 16:
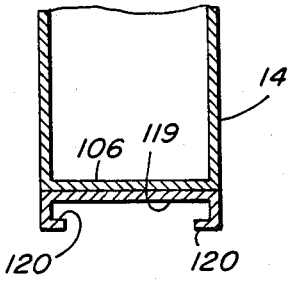

Another type of magazine 14 is formed of one piece as shown in FIGS. 14 to 16. The one piece magazine has a closed bottom 106. In FIG. 14 flanges are provided by securing a plate 110 to the bottom of the magazine 14 by permanent means such as a spot weld 114 or by removable means such as screws. The plate extends beyond the edges of the walls of the magazine thereby providing flanges 115. The same principle of staggered mating interrupted flanges and slots would be applied to assemble the magazine to the pommel as described above.

Another alternative construction is seen in FIG. 15 wherein a T-shaped plate 116 is removably secured as by screws 118 or permanently attached by riveting or spot-welding or the like depending upon the construction of the pommel and its desired thickness.

Figure 13:
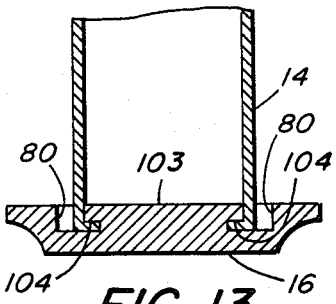
FIGS. 13 to 16 are partial elevational views of the butt end of magazines showing alternate forms of construction.

A closed bottom magazine 14 may be secured to a pommel as shown in FIG. 13, i.e. as having an interior island. In this instance, construction such as shown in FIG. 16 would be employed where a channel section 119 having depending inwardly turned flanges 120 would be secured either permanently or temporarily to the closed bottom 106 of the magazine 14.

There may be many forms and configurations of structure for securing the pommel to the magazine, the above being merely illustrations and not limitations thereof.

While the above is illustrative of one form of pommel and its attachment to a gun butt, it will be appreciated by those skilled in the art that equivalent constructions may be employed without departing from the scope or intent of this invention while being covered by the claims hereof.

I claim:

1. Means for mounting a pommel to a cartridge magazine which is slidable into a recess in a butt end of a grip of a handgun, the magazine having a cartridge discharging end and a closed end, the pommel having a first surface engageable with the butt end of the grip and a smooth continuous, uninterrupted surface opposite the first surface, a recessed interior formed in the first surface and an exterior periphery complementary to and coincident with the shape of the butt end of the grip of the handgun, a releasable interlock means on the closed end of the magazine and complementary releasable interlock means wholly within the internal confines of the recessed interior of the pommel, whereby the pommel and the magazine may be secured together with said interlock means completely obscured from view when the magazine is inserted into the grip of the handgun and only the interrupted surface and the exterior periphery of the pommel are visible.

2. Mounting means according to claim 1 including releasable detent means to maintain the pommel and magazine in assembled relationship.

3. Means for mounting a pommel to a cartridge magazine which is slidable into a recess in a butt end of a grip of a handgun, the magazine having a cartridge discharge end and a closed end;

the pommel having a continuous exterior wall complementary to and coincident with the shape of the butt end of the grip of the handgun, an interior recess in the pommel, defined by the interior surface of the wall, longitudinal slots formed in the interior surface of the wall, longitudinal flanges formed at the butt end of the magazine, and staggered mating interruptions formed in the flanges and the slotted wall to permit the closed end of the magazine to enter the interior recess to align the flanges with the slots for sliding engagement to attach the pommel to the magazine.

4. Mounting means according to claim 3 including releasable detent means to maintain the pommel and magazine in assembled relationship.

5. Means for attaching a pommel to a butt end of a grip of a handgun of the type having a cartridge magazine insertable in a recess in the butt end of the grip, the magazine having a cartridge discharge end and a closed end comprising:

flanges at the closed end of the magazine, which flanges are interrupted between the ends of the magazine, the pommel having a recessed interior with slotted walls accessible only from the recessed interior, the slotted walls being interrupted between the ends of the recessed interior in staggered mating relationship to the interrupted flanges of the magazine, whereby the closed end of the magazine may be inserted into the recessed interior of the pommel to slide the flanges into the slotted walls.

6. Mounting means according to claim 5 including releasable detent means to maintain the pommel and magazine in assembled relationship.

7. Mounting means according to claim 5 wherein the flanges on the magazine extend outwardly.

8. Mounting means according to claim 5 wherein the flanges on the magazine extend inwardly.

* * * * *